US010803702B1

(12) United States Patent
Phan

(10) Patent No.: US 10,803,702 B1
(45) Date of Patent: Oct. 13, 2020

(54) CARD SELECTION SYSTEM FOR ONLINE GAME PLAY

(71) Applicant: Toan Phan, San Francisco, CA (US)

(72) Inventor: Toan Phan, San Francisco, CA (US)

( * ) Notice: Subject to any disclaimer, the term of this patent is extended or adjusted under 35 U.S.C. 154(b) by 498 days.

(21) Appl. No.: 15/811,931

(22) Filed: Nov. 14, 2017

Related U.S. Application Data

(60) Provisional application No. 62/422,178, filed on Nov. 15, 2016.

(51) Int. Cl.
*G07F 17/32* (2006.01)

(52) U.S. Cl.
CPC ..... *G07F 17/3216* (2013.01); *G07F 17/3211* (2013.01); *G07F 17/3293* (2013.01)

(58) Field of Classification Search
None
See application file for complete search history.

(56) References Cited

U.S. PATENT DOCUMENTS 1,866,063 A * 7/1932 Sloan ..... A63F 1/12 273/144 B
3,057,625 A * 10/1962 Livingston ..... A63F 5/04 273/309
4,441,714 A * 4/1984 Goott ..... A63F 1/00 273/138.2
5,088,737 A * 2/1992 Frank ..... A63F 7/048 273/139
5,590,879 A * 1/1997 Tripp ..... A63F 7/048 273/144 B
5,738,350 A * 4/1998 Lai ..... A63F 7/048 273/139
6,120,024 A * 9/2000 Lind ..... A63F 7/048 273/144 A
7,775,521 B1 * 8/2010 Itkis ..... G07C 15/001 273/144 B
8,387,981 B2 * 3/2013 Caron ..... A63F 7/048 273/144 A
RE45,679 E * 9/2015 Jones ..... A63F 3/00
9,147,307 B2 9/2015 Meyer
9,314,689 B2 4/2016 Chun
(Continued)

FOREIGN PATENT DOCUMENTS

WO WO2014132133 9/2014

OTHER PUBLICATIONS

Brabingo, Electronic BlackJack Table by Brabingo , Feb. 9, 2011 , https://www.youtube.com/watch?v=zqeLAKceZP4 , time 0:00-7:35, p. 1 (Year: 2011).*

*Primary Examiner* — Tramar Y Harper
(74) *Attorney, Agent, or Firm* — Goldstein Law Offices, P.C.

(57) ABSTRACT

A card selection system, for use with an online gaming system, for allowing verifiable, physical selection of cards for players while playing a card game on the online gaming system. A plurality of card identifying balls are provided in a vessel, each ball representing one of the cards of a standard card deck. The balls are sequentially deployed from the vessel into a delivery tube, and are read by a sensor to provide identity data for each ball, so that a corresponding virtual card can be associated with the appropriate player. A video feed of the balls entering the delivery tube is recorded so that any dispute of the randomization of card selection can be verified by replaying the video feed.

10 Claims, 4 Drawing Sheets

(56) References Cited

U.S. PATENT DOCUMENTS

| | | | | |
|---|---|---|---|---|
| 9,552,685 | B1 * | 1/2017 | Itkis | G07C 15/001 |
| 2002/0094860 | A1 | 7/2002 | Itkis et al. | |
| 2002/0113369 | A1 * | 8/2002 | Weingardt | A63F 3/0645 273/269 |
| 2003/0020235 | A1 * | 1/2003 | Brenner | A63F 7/048 273/144 B |
| 2005/0098944 | A1 * | 5/2005 | Brandstetter | G07C 15/001 273/144 A |
| 2006/0097446 | A1 * | 5/2006 | Toyoda | A63F 5/02 273/144 R |
| 2007/0108700 | A1 * | 5/2007 | Bigelow | G07C 15/001 273/138.1 |
| 2007/0225055 | A1 * | 9/2007 | Weisman | A63F 1/14 463/11 |
| 2008/0070660 | A1 * | 3/2008 | Brunelle | G07F 17/32 463/13 |
| 2011/0045890 | A1 * | 2/2011 | Khal | G07F 17/329 463/19 |
| 2012/0184346 | A1 | 7/2012 | Kepler et al. | |
| 2012/0190430 | A1 * | 7/2012 | Puyol | G07F 17/38 463/22 |
| 2014/0029795 | A1 * | 1/2014 | Rommer | G06K 9/00536 382/103 |
| 2014/0221073 | A1 | 8/2014 | Pockaj | |
| 2014/0246829 | A1 | 9/2014 | Jones | |
| 2014/0248935 | A1 | 9/2014 | Williams et al. | |
| 2015/0045103 | A1 * | 2/2015 | Tripp | G07F 17/3225 463/19 |
| 2016/0016074 | A1 * | 1/2016 | Jones | G07F 17/3241 273/144 B |

* cited by examiner

CARD SELECTION SYSTEM FOR ONLINE GAME PLAY

CROSS REFERENCES AND RELATED SUBJECT MATTER

This application is a non-provisional filing of provisional patent application Ser. No. 62/422,178, filed in the United States Patent Office on Nov. 15, 2016, from which priority is claimed and which is incorporated by reference herein in its entirety.

TECHNICAL FIELD

The present disclosure relates generally to card selection systems. More particularly, the present disclosure relates to a verifiable card selection system for use with online gaming systems.

BACKGROUND

Over the years, countless card games have been developed that employ a standard 52 card deck to determine the ranking and outcome of various players. Generally, within these games, the element of chance with regard to which cards any given player receives is critical to the fairness to the players.

Because of the finite nature of the card deck, various strategies have been employed to provide a player a relative advantage. Among such strategies is card counting. A player that is counting cards will take note of the cards that have been already dealt and thus no longer in the deck, and will adjust play and betting strategies accordingly. In response, casinos typically combine multiple decks of cards into a single shoe from which cards are dealt.

In casinos, significant procedures have been put in place to ensure the fairness to each player, and to aid players in feeling confident about the integrity and fairness of card selection during the game. For example, a rigid procedure is followed by dealers when they shuffle the cards, to guarantee an even playing field.

With the advent of online gaming, players have less confidence in the fairness of card selection. This is understandable, since the 'cards' are being selected by the very program that is determining the outcome—in favor of one player, another player, or even in favor of the house. The fact that it is actually the house that wrote the very program that either makes the player or the house the winner can understandably undermine the player's trust in the system.

Part of the problem with existing card selection systems, then, is that the purported randomization of cards occurs only as an electronic impulse, internally within the system. There is no way to audit or review the card selection, or verify its randomness.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a card selection system for an electronic gaming system that employs physical randomization. Accordingly, the present disclosure provides a system wherein cards are represented by physical items that are each associated with a particular playing card, such that selection of that physical item results in a selection event for its associated card within the electronic gaming system.

It is another aspect of an example embodiment in the present disclosure to provide a card selection system that quickly and reliably selects cards for game play by quickly and reliably identifying the physical items representing the playing cards. Accordingly, each playing card is represented by a ball that is contained within a vessel. To determine the next card for game play, a single ball is released and identified by the system.

It is yet another aspect of an example embodiment in the present disclosure to provide a card selection system that is verifiable. Accordingly, the selection system is observed and recorded by at least one video camera. If card selection is contested by a player, the video recording of that card selection even may be retrieved and reviewed.

Accordingly, the present disclosure describes a card selection system, for use with an online gaming system, for allowing verifiable, physical selection of cards for players while playing a card game on the online gaming system. A plurality of card identifying balls are provided in a vessel, each ball representing one of the cards of a standard card deck. The balls are sequentially deployed from the vessel into a delivery tube, and are read by a sensor to provide identity data for each ball, so that the corresponding card can be associated with the appropriate player. A video feed of the balls entering the delivery tube is recorded so that any dispute of the randomization of card selection can be verified by replaying the video feed.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
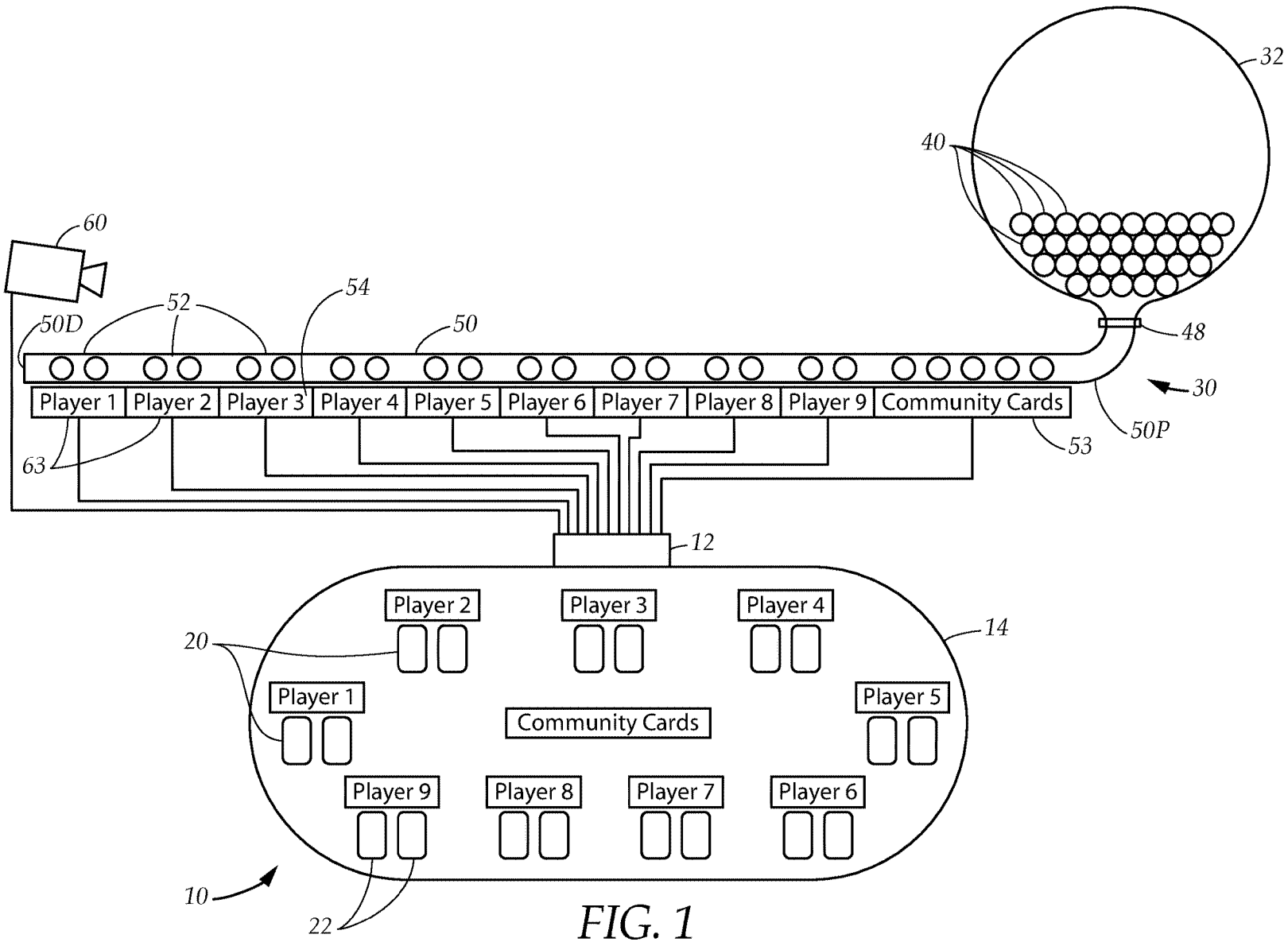
FIG. 1 is an elevational view, diagrammatically illustrating a card selection system in accordance with the present disclosure, as integrated with an online gaming system.

FIG. 1 illustrates a gaming system 10, diagrammatically illustrated, including a controller 12, and a game status representation 14. The gaming system 10 is used for selecting card while playing a game, having a plurality of players, the game having rules regarding game play. The game status representation 14 of FIG. 1 may be considered to be an actual video display of a virtual gaming table, or it may be just a graphical representation of internal status of players and other card positions within the system, and any cards currently associated with such players and positions.

The gaming system 10 may be configured to operate with a plurality of users, including various classes of users. Among the users are players, represented within the system by player locations 20, each player location 20 may be empty or may be occupied by one or more virtual cards 22. Each card is a representation of a playing card, which has a value that may be a numeric value between two and ten, or a jack, queen, king, or ace; and a suit such as clubs, heart, diamonds, or spades. The cards in each player location may be varied according to the rules of the particular game being played by the gaming system. For example one or more cards are emptied from the player location when cards are discarded or at the end of a round of play. The gaming system 10 may be configured to play a card game, such as poker, blackjack, or any other card game. Accordingly, each player location may be configured to contain a certain maximum number of cards, in accordance with the rules of the game being played. The game status representation 14 may also include a community cards location in the center for displaying additional cards selected that may be used during game play subsequent to cards being initially dealt to the players.

In accordance with the principles of the present disclosure, a card selection system 30 is provided for operation in conjunction with the gaming system 10. The card selection system interfaces with the controller 12 to provide data about cards that are selected. Such data is provided as card identifying data which may be provided in direct relation to a specific player, or may be provided as a stream or sequence of card identifying data, such that the placement and assignment of the associated cards with respect to the players is made by the gaming system 10, assigned in sequence according to the rules of the game and progression of the game in accordance with choices and 'moves' of the players—such as the decision to discard and replace cards, or the decision to take another card.

Figure 2:
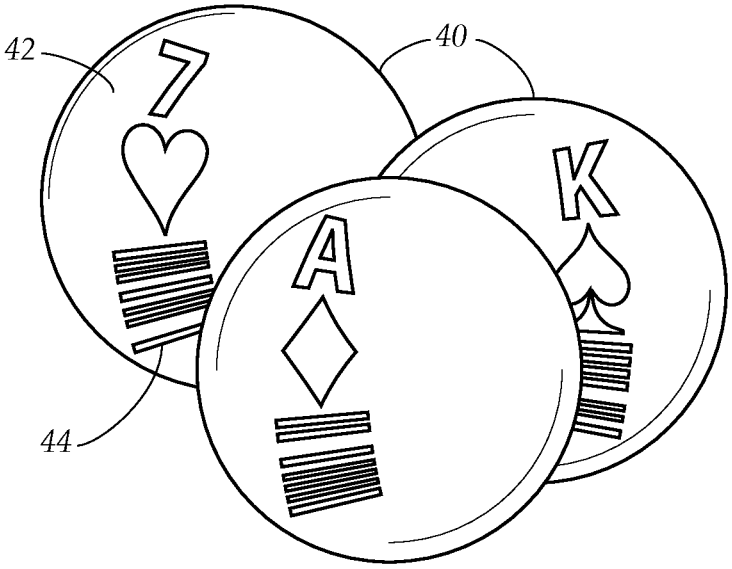
FIG. 2 is a diagrammatic perspective view, illustrating a plurality of card identifying balls, having card indicia and machine readable indicia.

The card selection system 30 includes a vessel 32 that contains a plurality of card identifying balls 40. The card identifying balls 40, each have a unique identity that includes a value and suit. Preferably, fifty-two card identifying balls 40 are contained within the vessel, encompassing every card in a standard deck. Other variations may include more than one set of fifty-two balls, to simulate a multiple card deck deal. Referring to FIG. 2, the value and suit is visually displayed on the ball as card identifying indicia 42, and also as a machine readable indicia 44. The machine readable indicia 44 may be visually readable, such as a bar code, or may be readable using other means, such as an RFID tag or magnetic tag.

Referring again to FIG. 1, during game play, the balls 40 are released from the vessel 32, one by one, into a delivery tube 50. Controlling the release of the card identifying balls 40 into the delivery tube 50 may be accomplished by a release mechanism 48 at the junction of the vessel 32 and delivery tube 50. When one of the card identifying balls 40 enters the delivery tube 50, it represents that its associated card has been selected for game play, just as if a physical playing card were dealt by a dealer. Apparatus may be provided in conjunction with the vessel 32 to randomize the balls 40, to increase the unpredictability of any given ball 40 being the next one selected. As an example, the vessel 32 and balls 40 may be configured like the number selection system commonly used for Keno or Bingo games. Accordingly, a blower may be provided in conjunction with the vessel to excite and thereby thoroughly randomize the positioning of the balls within the vessel.

The delivery tube 50 has a proximal end 50P near the vessel 32 and has a distal end 50D fully opposite therefrom. The delivery tube 50 may include a plurality of sequentially and linearly arranged positions 52, which may be appropriately labeled with position indicia 54. These positions 52 may be associated with specific players within the gaming system. A video camera 60 may be provided to monitor and record all or specific portions for the delivery tube 50. Thus, the video camera 60 may be fixed and capture the entire delivery tube 60, or may pan and zoom to capture specific parts of the delivery tube 50 during card selection.

As each card identifying ball 40 is released into the delivery tube 50 at the proximal end 50P, it will roll down the delivery tube 50 toward the distal end 50D. The delivery tube 50 can be configured so that the ball will stop when it actually reaches the previously deployed ball 40. Alternatively, gates or related mechanisms within the delivery tube 50 may be employed to stall the ball and prevent it rolling further down the tube 50. So, for example, if one of the positions 52 has space for more balls than cards are actually drawn by the player associated with that position, when a card is drawn by the next player, gating elements can prevent that next ball from rolling down the delivery tube 50 and entering the position of the previous player. Instead the ball will stop within the next position 52, which is associated with said next player.

Figure 3:
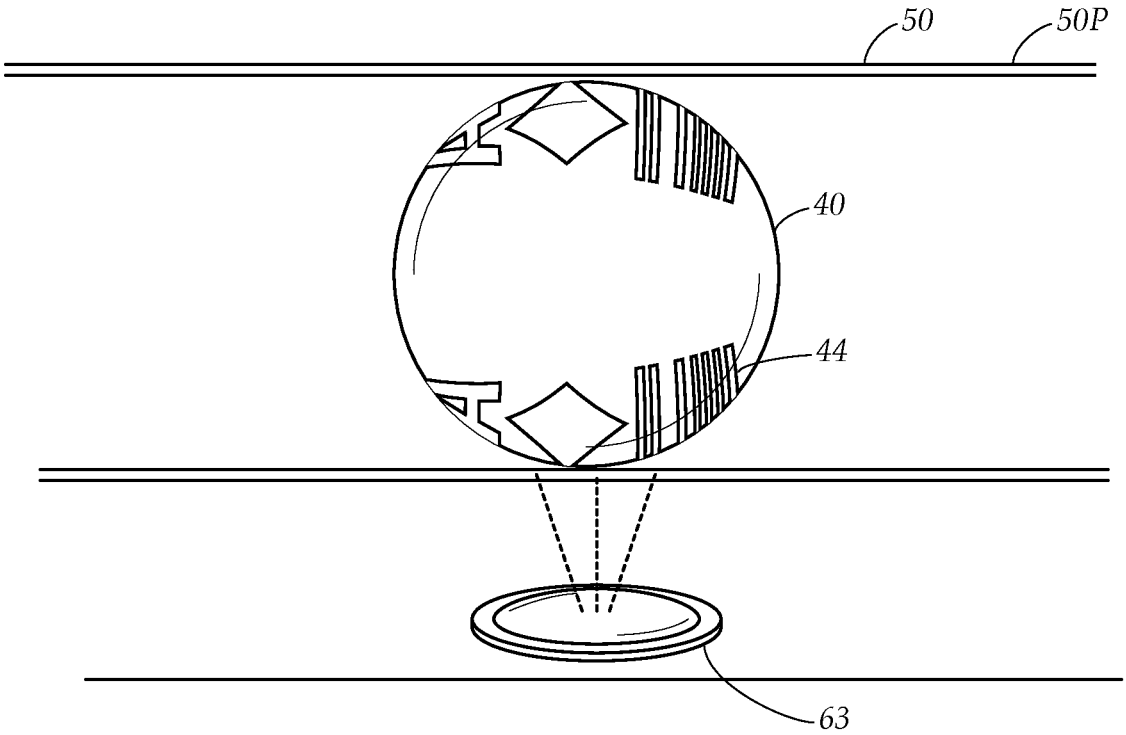
FIG. 3 is a diagrammatic perspective view, illustrating one of the card identifying balls within a card delivery tube, being read by a ball identity sensor.

Referring to FIG. 3, the card identifying balls 40 are read by a ball identity sensor 60. The ball identity sensor 63 is in communication with the controller 12, and is capable of uniquely identifying the ball using the machine readable indicia 44. As previously noted, the ball identity sensor 63 can use any suitable technology, both presently and prospectively available, to identify the card identifying ball 40 and generate identifying data. The identifying data is provided to the controller, which then will associate the value and suit of that card with the appropriate player within the game, as if it were drawn from a deck of cards. Note that the ball identity sensor 63 may be positioned near the proximal end 50P of the delivery tube, such that it will provide identifying data as the ball 40 rolls down the tube. Alternatively, multiple ball identity sensors 63 may be provided along the delivery tube, at each of the player positions 52 shown in FIG. 1, such that the balls that presently occupy a player position can be determined at any time. Among the player positions 52 may be a community position 53, which collects additional randomized cards that may be used to represent the dealer or as additional cards drawn during the round, as appropriate for the particular game being played. Virtual cards associated with card identifying balls 40 that land in the community position 53 may be displayed in the "community cards" location on the game status display.

After the round of game play has ended, the system may be configured so that the balls 40 exit the distal end 50D and are stored as "used" balls until it is desired to return them to the vessel 32, just as used cards in a casino are stored until the deck is reshuffled. Thus, in accordance with rules of the game, the vessel 32 may be exhausted to a predetermined point—just as cards in a casino shoe are played until the shuffle card is encountered—and then the "used" balls are returned to the vessel 32. Alternatively, if desired, the used balls may be returned directly to the vessel 32 at the end of each round. If that is the case, the apparatus may also be configured so that the balls 40 are expelled from the delivery tube 50 back into the vessel 32 through the proximal end 50P, using pneumatic pressure or any other suitable means.

Figure 4:
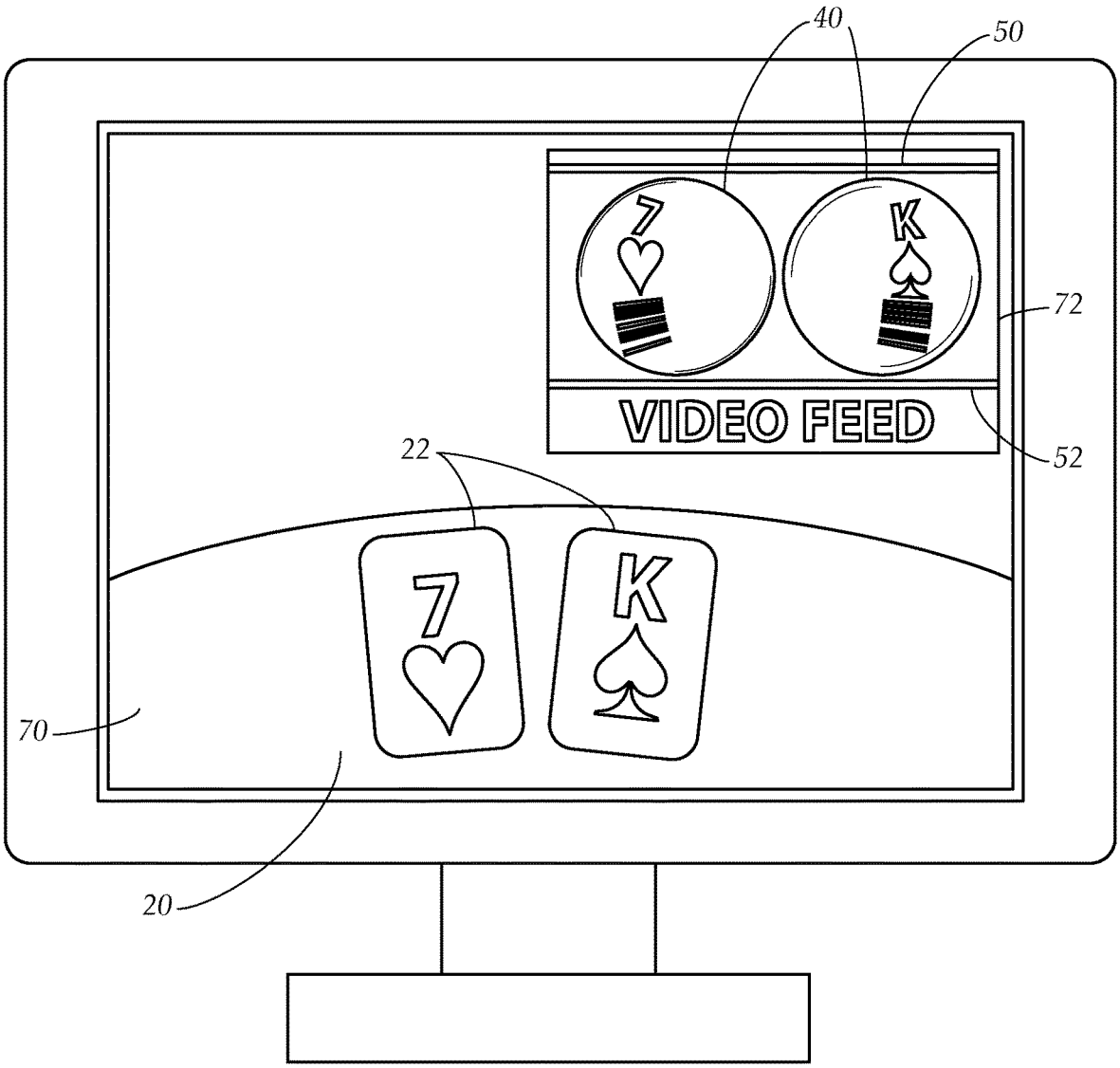
FIG. 4 is a front elevational view, illustrating a video display that depicts both game play and a video feed of the card selection.
Figure 5:
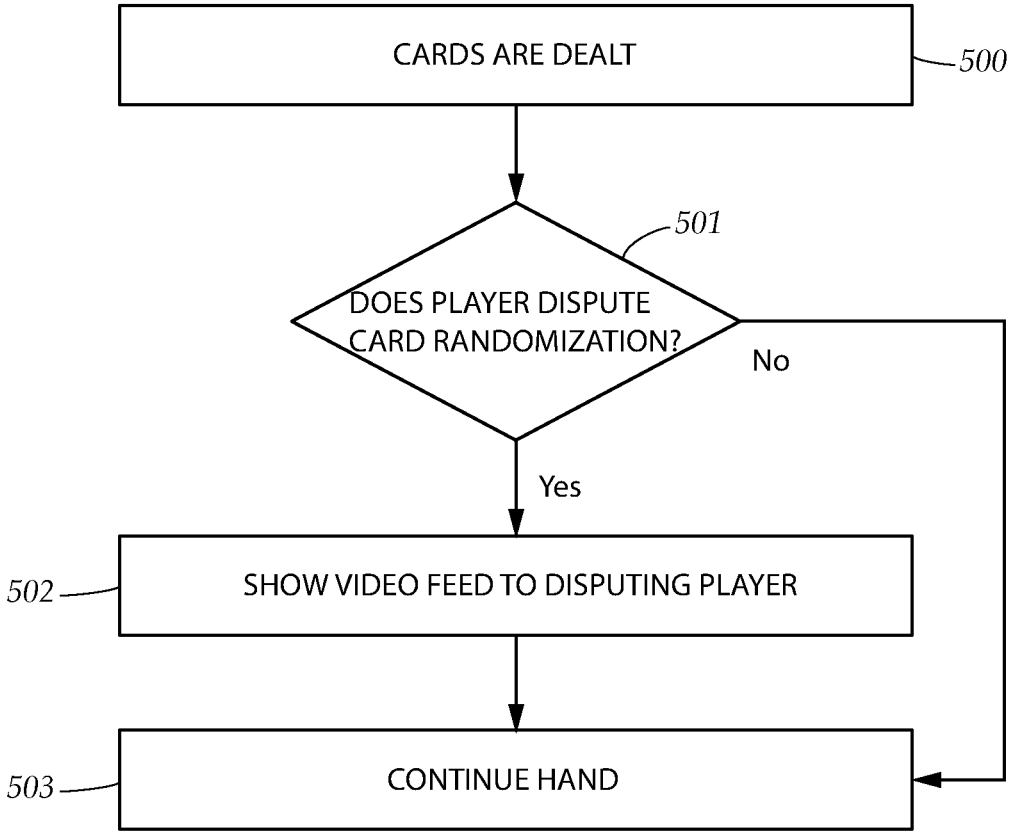
FIG. 5 is a flow diagram, providing an example where game play may be interrupted by a player's dispute of randomization, to view the video recording of the card selection in question.

As previously described, as the card identifying balls 40 are deployed, a video feed is recorded of the delivery tube 50, for allowing the user to verify the identity of the cards drawn by the system on his or her behalf. Referring to FIG. 4, a game display 70 illustrates the player location 20, and the virtual cards 22 drawn by the player. A video feed display 72 may be shown to the player, illustrating the corresponding card identifying balls 40 as they are drawn and roll into the player position 52 within the tube 50. Note that typically, the video feed display 72 is not displayed to the player. But if, in accordance with the rules set forth by the system, the player wishes to contest or dispute the card randomization, the recording of the video feed will be replayed for that player and displayed in the video feed display 72 as indicated in FIG. 4. Referring to the flow diagram of FIG. 5, generally the cards are dealt 500 to some or all players. If the player does not dispute the card randomization 501, the hand will continue 503. But if the player does dispute the card randomization 501, the video feed is shown to the disputing player 502, and then (when appropriate) the hand will continue 503.

Note that while adhering to the various randomization principles described hereinabove, numerous variations are possible. For example, the cards for a given hand may be "drawn" before the hand commences, perhaps while the previous hand is being played, or may occur in real time, as the hand is played. In addition, the card selection system may be provided in card selection "farms" where multiple vessels and delivery tubes are located in a physical space where they can be used to serve multiple games that are being played simultaneously on the gaming system. Each card selection system has its own video feed that is recorded and can be monitored by system personnel or by players that dispute the randomization.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a card selection system for allowing cards to be physically selected in an online gaming system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A card selection system, for use in conjunction with a game having a plurality of players, for selecting cards associated with the players during game play, comprising:

a set of 52 card identifying balls, each of the card identifying balls have a value and a suit that represents one of the cards in a standard card deck, the card identifying balls together representing all of the cards in said standard card deck;

a vessel for containing the card identifying balls;

a delivery tube connected to the vessel;

a release mechanism for providing one of the card identifying balls in the vessel to the delivery tube;

a ball identifying sensor, for determining the value and suit of said one of the card identifying balls as it enters the delivery tube and assigning a virtual card having said value and suit to one of the players during game play;

a video camera directed toward the delivery tube, for capturing images and video of the card identifying balls as they enter the delivery tube; and a video feed display for replaying video previously captured by the video camera to one of the players to evidence previous selection of virtual cards for said player;

wherein each card identifying ball has card identifying indicia that visually displays the value and suit of said card identifying ball and also has machine readable indicia that encodes the value and suit of said card identifying ball such that it may be determined by the ball identifying sensor.

2. The card selection system as recited in claim 1, wherein the delivery tube has a plurality of positions that are arranged sequentially along said delivery tube, adjacent to each of said positions is printed indicia that indicates one of the players, so that each player can see the card identifying balls that represent the virtual cards associated with said player.

3. The card selection system as recited in claim 2, wherein the cards associated with the player represent cards dealt to the player, and wherein the delivery tube further comprises community positions, for associating at least one of the card identifying balls with a pool of selected virtual cards that may be used during game play after the virtual cards are initially dealt to the players.

4. A card selection system, for use in conjunction with a game having a plurality of players, for selecting cards associated with the players during game play, comprising:

a set of 52 card identifying balls, each of the card identifying balls have a value and a suit that represents one of the cards in a standard card deck, the card identifying balls together representing all of the cards in said standard card deck;

a vessel for containing the card identifying balls;

a delivery tube connected to the vessel, the delivery tube having a plurality of player positions, each player position associated with one of the players;

a release mechanism for providing one of the card identifying balls in the vessel to the delivery tube;

a ball identifying sensor, for determining the value and suit of said one of the card identifying balls as it enters the delivery tube and assigning a virtual card having said value and suit to one of the players during game play;

a game status representation, having a player location associated with each of the players, each player location having a card display for displaying virtual cards that have been selected for said player;

a video camera directed toward the delivery tube, for capturing images and video of the card identifying balls as they enter the delivery tube; and a video feed display for replaying video previously captured by the video camera to one of the players to evidence previous selection of virtual cards for said player.

5. The card selection system as recited in claim 4, wherein the set of 52 card identifying balls further comprises two sets of 52 card identifying balls, and wherein each card identifying ball has card identifying indicia that visually displays the value and suit of said card identifying ball and also has machine readable indicia that encodes the value and suit of said card identifying ball such that it may be determined by the ball identifying sensor.

6. The card selection system as recited in claim 5, wherein the delivery tube has a plurality of positions that are arranged sequentially along said delivery tube, adjacent to each of said positions is printed indicia that indicates one of the players, so that each player can see the card identifying balls that represent the virtual cards associated with said player that are displayed at the player location on the game status representation.

7. The card selection system as recited in claim 6, wherein the delivery tube further comprises community positions, for associating at least one of the card identifying balls with a pool of selected virtual cards that may be used during game play after the virtual cards are initially dealt to the players, and wherein the game status representation has a community cards location for displaying virtual cards associated with card identifying balls in the community positions.

8. A card selection method, for facilitating play of a game by a plurality of players, the game having rules, comprising the steps of:

(a) providing a vessel and a delivery tube, the vessel having a set of 52 card identifying balls, each card identifying ball having a value and suit representing one of the cards in a standard card deck, each card identifying ball having machine readable indicia representing the value and suit associated with said card identifying ball;

(b) providing a ball identifying sensor adjacent to said delivery tube;

(c) dispensing one of the card identifying balls into the delivery tube, while capturing video of said card identifying ball entering said delivery tube;

(d) reading the value and suit of said card identifying ball as it enters said delivery tube by reading the machine readable indicia on said card identifying ball by said ball identifying sensor;

(e) associating a virtual card having said value and suit with one of the players;

(f) repeating steps (c), (d), and (e) until sufficient cards have been selected for each of the players in accordance with the rules of said game; and (g) verifying that the virtual cards associated with said player are correctly associated with said player by replaying the video of the card identifying balls associated with said player entering the delivery tube.

9. The card selection method as recited in claim 8, wherein the delivery tube has a plurality of player positions, each player position associated with one of the players; wherein the step of dispensing one of the card identifying balls into the delivery tube further comprises rolling said card identifying ball into one of the player positions; and wherein the step of capturing video of said card identifying ball as it enters the delivery tube further comprises associating said captured video with the player associated with the player position that said card identifying ball rolls into.

10. The card selection method as recited in claim 9, wherein after sufficient cards have been selected for each of the players in accordance with the rules of said game, the step is performed of selecting at least one community card by repeating steps (b), (c), and (d) at least once.

* * * * *